United States Patent [19]

Ives et al.

[11] Patent Number: 5,015,914

[45] **Date of Patent: * May 14, 1991**

[54] COUPLERS FOR EXTRACTING RF POWER FROM A GYROTRON CAVITY DIRECTLY INTO FUNDAMENTAL MODE WAVEGUIDE

[75] Inventors: Robert L. Ives, Cupertino; Howard R. Jory, Menlo Park; Albert D. LaRue, Los Altos, all of Calif.

[73] Assignee: Varian Associates, Inc., Palo Alto, Calif.

[ * ] Notice: The portion of the term of this patent subsequent to Jul. 25, 2006 has been disclaimed.

[21] Appl. No.: 282,401

[22] Filed: Dec. 9, 1988

[51] Int. Cl.[5] ..... H01J 25/00

[52] U.S. Cl. ..... 315/4; 315/5; 331/91

[58] Field of Search ..... 315/3, 4, 5, 3.6, 39.3; 330/4.7, 42.43; 333/21 R, 228; 372/2; 331/91

[56] References Cited

U.S. PATENT DOCUMENTS

| | | | |
|---|---|---|---|
| 4,200,820 | 4/1980 | Symons | 315/4 |
| 4,224,576 | 9/1980 | Granatstein et al. | 315/5 X |
| 4,362,968 | 12/1982 | Chu et al. | 315/5 X |
| 4,367,446 | 1/1983 | Hall | 333/21 R X |
| 4,398,121 | 8/1983 | Chodorow et al. | 315/5 X |
| 4,460,846 | 7/1984 | Taylor | 315/5 X |
| 4,550,271 | 10/1985 | Lau et al. | 315/5 X |
| 4,567,401 | 1/1986 | Barnett et al. | 333/230 X |
| 4,668,894 | 5/1987 | Barnett et al. | 315/4 |
| 4,851,788 | 7/1989 | Ives et al. | 333/5.51 X |

*Primary Examiner*—Eugene R. LaRoche
*Assistant Examiner*—Seung Ham
*Attorney, Agent, or Firm*—Stanley Z. Cole; Peter J. Sgarbossa; Sheri M. Novack

[57] ABSTRACT

In a gyrotron cavity resonator, generated energy is extracted into a symmetric set of fundamental-mode waveguides by ports disposed to couple energy in phase from the operating electromagnetic mode but in anti-phase with respect to an unwanted mode of lower cut-off frequency than the operating mode, thereby neutralizing coupling to the unwanted mode. A second set of interspersed ports may be disposed to load degenerate, orthogonal modes.

13 Claims, 3 Drawing Sheets

COUPLERS FOR EXTRACTING RF POWER FROM A GYROTRON CAVITY DIRECTLY INTO FUNDAMENTAL MODE WAVEGUIDE

FIELD OF THE INVENTION

The invention pertains to microwave electron tubes, such as the gyrotron, using beam-interaction cavity circuits operating in higher order modes. The generated wave energy is separated from the beam into an output waveguide.

PRIOR ART

In present cyclotron art, the cavity is excited in a circularelectric field mode, $TE_{onm}$. The generated $TE_{on}$ waveguide wave is extracted by passing axially through the beam collector to an output window. The electron beam is spread out and collected on the wall of the waveguide, which is usually enlarged in this region to reduce the dissipated power density. The separation has posed many problems. Unseparated electrons go out the waveguide and bombard the dielectric vacuum window. Also, the $TE_{on}$ is not the fundamental waveguide wave, so directing and utilizing it entails problems of mode conversion and mode interference.

U.S. Pat. No. 4,200,820, issued Apr. 19, 1980 to Robert L. Symons, describes a method of diverting the output waveguide from the electron-beam channel by a diagonal mirror with an aperture for beam passage. This brings some problems in that local, non-propagating fields generated at the aperture distort the wave "reflection" in the mirror generating competing lower-order mode in the interaction cavity.

U.S. Pat. No. 4,460,840, issued July 17, 1984 to Norman G. Taylor, describes a method of diverting the electrons into an enlarged collector while allowing the circular wave to pass through a waveguide, smaller than the collector, to the external load.

For many uses, such as feeding antennae, it is still necessary to convert the power into a fundamental mode such as the $TE_{10}$ in rectangular waveguide. Many mode converters are known in the waveguide art, but they suffer from waveguide mismatches, narrow bandwidth or limited power-handling capacity.

SUMMARY OF THE INVENTION

An object of the invention is to provide coupling from a higher-order mode in a cavity into fundamental modes in output waveguides.

A further object is to provide output coupling which is inherently free from exciting lower-order modes in the cavity.

A further object is to provide phase-locked coupling into a plurality of output waveguides.

These objects are realized by a plurality of output ports disposed to neutralize coupling to cavity modes of cutoff frequency lower than the cavity operating frequency. This is done by locating each pair of similar ports symmetrically with respect to the fields of the cavity mode such that the couplings to lower-order modes excited by their coupling impedances are exactly out of phase.

DESCRIPTION OF THE PREFERRED EMBODIMENTS

Figure 1:
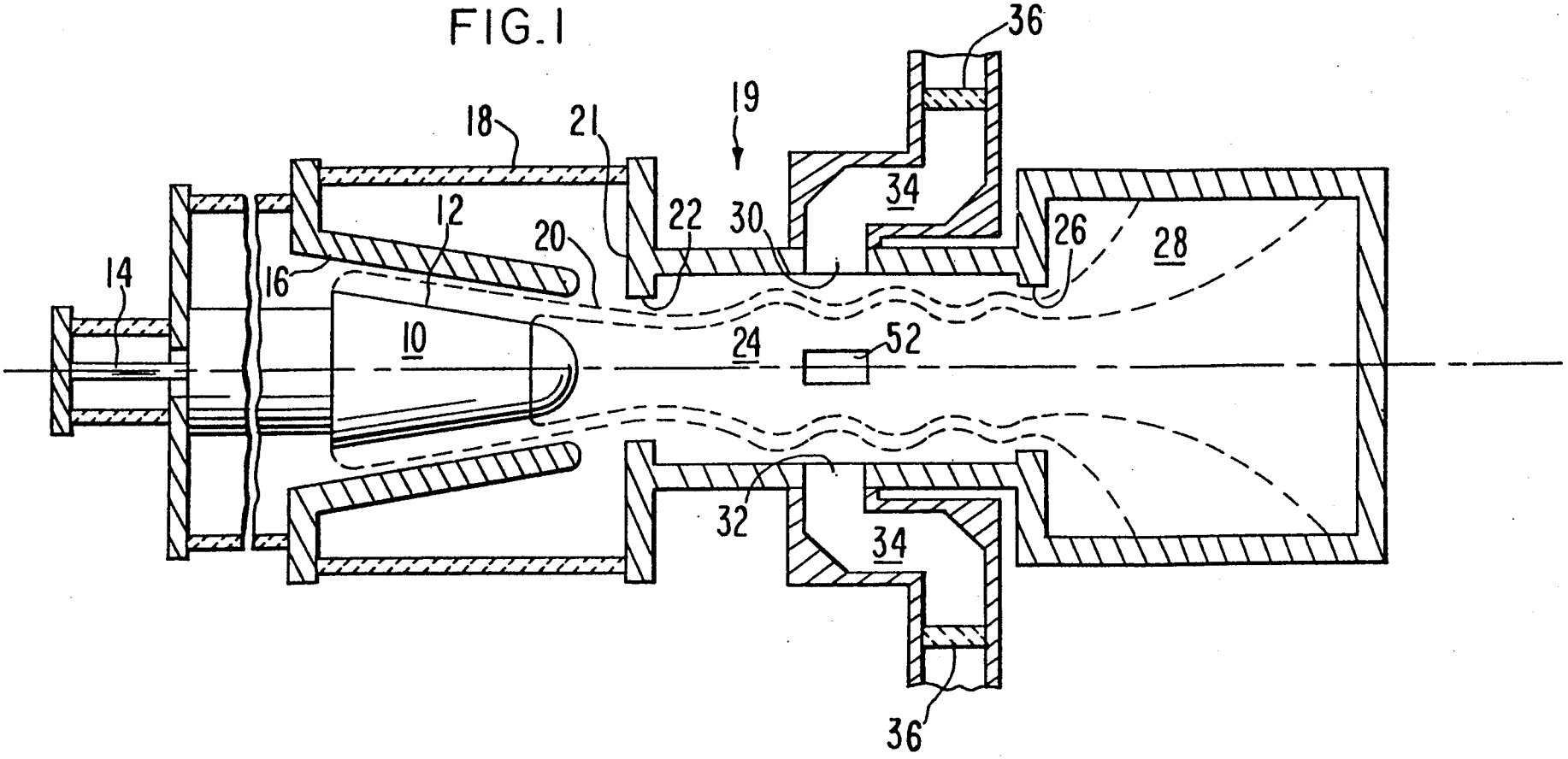
FIG. 1 is an axial section of a gyrotron embodying the invention.

FIG. 1 is an axial section of a gyrotron embodying the invention. A cathode structure 10 has a truncated electron-emissive surface 12 heated by an interior radiant heater (not shown) fed through an insulated lead-in 14. A hollow conical anode 16 supported by a hollow dielectric cylinder 18 from the metallic vacuum envelope 19 draws a hollow beam of electrons 20 from emitter 12. An axial magnetic field deflects beam 20 to produce an azimuthal motion component and limit its radial motion. Anode 16 may have a greater taper than emitter 12 to improve focusing of hollow beam 20 and give it an axial motion component. After leaving anode 16, beam 20 may be further accelerated by axial electric field to an apertured end-plate 21 of vacuum envelope 19. In this region, the axial magnetic field increases to reduce the beam diameter and increase the transverse velocity at the expense of axial velocity. Beam 20 passes through an input iris 22, preferably of diameter to be cut off as a waveguide for the operating frequency. Beyond iris 22, beam 20 passes through an interaction chamber 24 and leaves through an output iris into an enlarged beam collector 28. In collector 28, the axial magnetic field decreases rapidly so the beam expands under magnetic and spacecharge forces before being dissipated on the walls of collector 28, which are in contact with a fluid coolant.

Cavity 24 is resonant in a TE mode to interact with transverse components of electron motion. The generated electromagnetic wave energy is extracted through apertures 30, 32 leading via waveguides 34 and dielectric vacuum windows 36 to useful loads (not shown).

The described above, prior-art gyrotrons usually operated in $TE_0$ cavity modes and the power was extracted through the cylindrical collector into a $TE_0$ mode in axial, circular waveguide to prevent mode conversion by any parts which are not circularly symmetric. To get the wave into a fundamental-mode rectangular or circular waveguide where it could be handled by known methods requires elaborate mode convertors which are imperfrect, narrow-band, power lossy and subject to power-limiting arcing.

Figure 2:
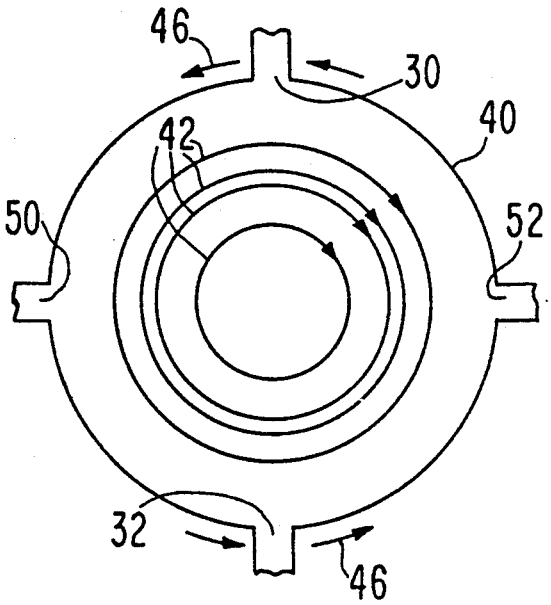
FIGS. 2, 3, 4 and 5 are sketches of the field lines of the pertinent modes in a cylindrical cavity.

The present invention provides means for coupling directly into $TE_{10}$ waveguide, thereby eliminating mode converters and window failure by beam electrons leaking through the collector. The simplest of these means is illustrated in FIG. 2. The unperturbed field patterns in circular waveguide 40 are shown for the $TE_{01}$. The other modes having lower cutoff frequencies are the $TE_{11}$ and $TE_{21}$ shown in FIGS. 3 and 4. The $TE_{11}$ and $TE_{21}$ have longer cut-off wavelengths than the $TE_{01}$ and can resonate in a waveguide designed for $TE_{01}$ thus resonate if the guide is terminated by a reflective member to form a cavity they can be coupled to the $TE_{01}$ mode by any mechanical asymmetries. Higher order modes with cutoff frequencies higher than the $TE_{01}$ generally cannot resonate in the $TE_{01}$ resonator which is cut off for them. Electric field lines 42 in the plane of the paper are shown. Magnetic lines are not shown. FIG. 2 is the $TE_{01}$ mode used in many conventional gyrotrons, where electric field lines 42 are closed, coaxial circles.

Figure 3:
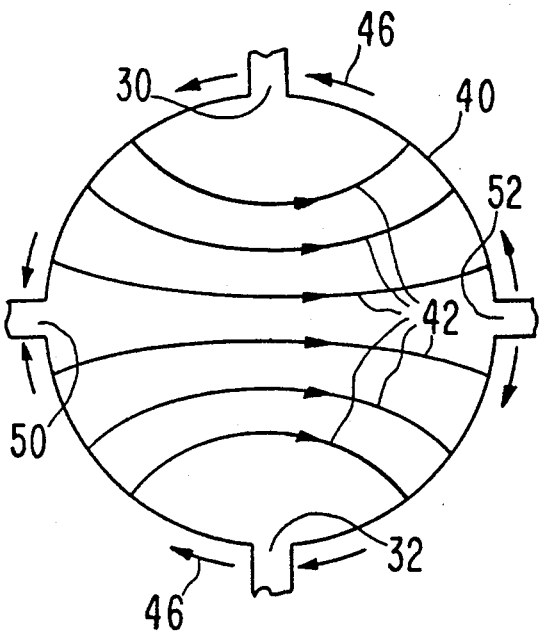

FIG. 3 is the lowest-order or "dominant" mode, the $TE_{11}$. It corresponds topographically to the $TE_{10}$ in rectangular waveguide.

Figure 4:
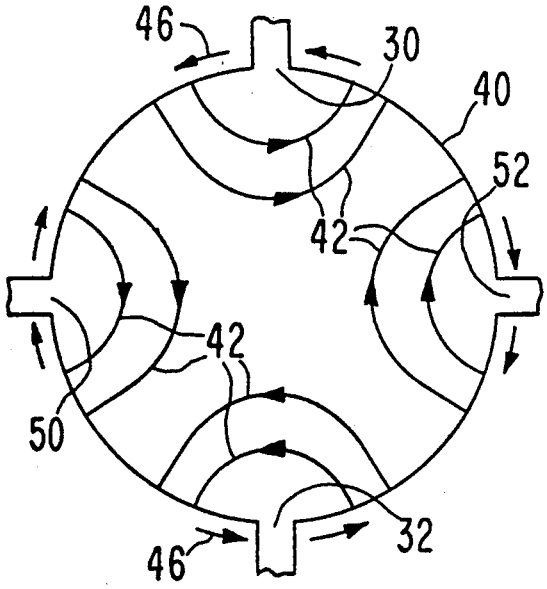

FIG. 4 is the $TE_{21}$ mode which may be used as the operating mode in gyrotrons embodying the invention.

Consider a resonator operating in the $TE_{01}$ mode. If we place a coupling aperture 30 in waveguide 40, the surface current 46, which flows in a circular path in the wall, creates a localized electric field across aperture 30 which extends into circular guide 40, falling off with distance from aperture 30. This unsymmetric field couples to and excites the $TE_{11}$ mode of FIG. 3 which, having a lower cutoff frequency than the operating $TE_{01}$ mode, can build up and resonate in a variety of axial variations depending on resonator length and terminations resulting in a loss of power in the desired $TE_{01}$ mode. Also, iris 22 of FIG. 1 may not be cut off for the lower-order mode, so rf power may travel into the gun region resulting in cathode heating or beam disruption.

According to the invention, a second coupling iris 32 is positioned 180 degrees in azimuth from first iris 30 and at the same axial position. The wall current 46 is in the opposite direction from that at iris 30, so the excitation of the lower-order mode $TE_{11}$ is exactly 180 degrees out of phase and the combination of the two apertures neutralizes the excitation of $TE_{11}$.

In the cavity at its $TE_{01}$ cutoff frequency, i.e. in a resonant state, only two other modes are above their cutoffs, the $TE_{11}$ described above and the $TE_{21}$ of FIG. 4. For the $TE_{21}$, it is evident that at any two points in the wall 180 degrees apart the wall currents 46 are in the same rotational direction, so the two coupling apertures 30, 32 of FIG. 2 would couple the $TE_{21}$ to the $TE_{01}$. If, however, a second pair of opposed apertures 50, 52 are placed 90 degrees from the first set 30, 32, their wall currents 46 are in opposite rotational sense from those at apertures 30, 32 so that the coupling from the $TE_{01}$ mode is neutralized. The coupling to $TE_{11}$ is also neutralized because in the $TE_{11}$ opposite rotational wall currents are always in opposite direction and in the $TE_{01}$ they are always in the same rotational direction.

The fact that mode decoupling is based on these fundamental symmetries shows that this neutralization is valid independently of the azimuthal rotation of the modes. The $TE_{11}$ has a two-fold degeneracy in that a 90 degree rotation produces an orthogonal mode uncoupled from the original. The $TE_{21}$ has a 4-fold degeneracy in that a 45 degree rotation produces an orthogonal mode. The mode polarization set up in a cylindrical resonator is generally determined by asymmetric excitation and loading conditions. In an oscillator, the mode with the lowest loading generally prevails. Of course, two degenerate modes can coexist. If their fields are 90 degrees out of phase, they form a circularly polarized wave.

According to the invention, power is extracted from a $TE_{01}$ or $TE_{21}$ resonator without exciting any other resonance of other modes. Four identical waveguides are coupled to the resonator through four identical coupling apertures 30, 32, 50, 52. To preserve the symmetry, waveguides 36 lead to identical loads. If desirable, the power in the guides can be combined into a single guide by symmetric combining circuits well known in the art. To eliminate effects of imperfect matches in the combiners, the guides are preferably of the same electrical length. To combine in the same polarization may require phase or polarization inverters.

Gyrotron operation does not require any particular mode pattern in the resonator because the cyclotron orbits of the electrons are generally small compared to the field pattern. $TE_{on}$ modes have prevailed in the prior art because the cavity losses are relatively small, the symmetry allows convenient damping of spurious non-circular modes, the electric field maxima are removed from the wall so the convenient, hollow electron beam can be at field maxima without undue interception on the wall, and all parts of the beam can interact with the same electric field.

However, other higher-order modes may be used. They also allow larger structures and large beams. For example, the $TE_{21}$ becomes feasible with the balanced couplings of the present invention. The $TE_{11}$ can resonate in the $TE_{21}$ resonator, but coupling to its from opposed ports 30, 32 is neutralized.

FIG. 4 shows the field pattern of a resonator in a $TE_{21}$ mode. Only the $TE_{11}$ is above cut off, so only one pair of opposed ports is needed for this $TE_{21}$ mode.

Figure 5:
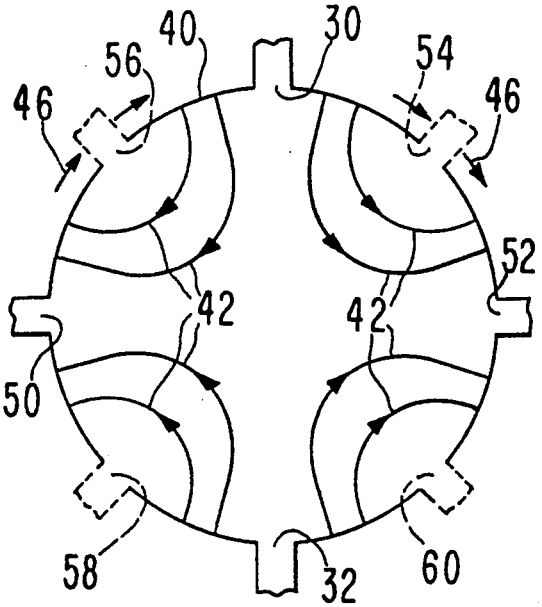

There is a second mode problem in most overmoded resonators. This is degenerate modes. For each $TE_{nm}$ mode, for example, there is an identical degenerate mode whose field pattern is rotated by 90/n degrees. FIG. 5 shows the $TE_{21}$ mode degenerate to the one shown in FIG. 4. By the symmetry of the field patterns, these two degenerate modes are uncoupled from each other. If the resonator is to operate in a first $TE_{21}$ mode as in FIG. 4, it will be loaded to extract energy from this first mode, but then the loading apertures will be at points of zero wall currents for the second degenerate mode of FIG. 5. No energy will be coupled out from this second mode, so the resonant impedance will be very high and the oscillation will build up in the unloaded degenerate mode rather than the desired operating mode. The invention comprises means for loading the unwanted degenerate modes more heavily than the desired operating modes, a process called "mode suppression". Additional loading ports such as 56, and 60 are provided, azimuthally rotated 45° from the output ports described above. These ports are heavily coupled to dissipative loads, such as well-known waveguide waterloads or dry lossy material such as plastic or ceramic containing carbon or metallic carbides. By following the same symmetry pattern as that of the useful mode, these mode suppressors do not disturb the fields of the desired modes by mode interference.

A somewhat different embodiment is to have the loading impedance at the secondary ports 56, and 60 exactly equal to that at primary ports 30, 32, and coupling the secondary ports to useful loads. Then both degenerate modes are used so their relative strengths are immaterial. The secondary outputs will be 90° out of phase with the primary ones, so combining the two sets requires 90° phase shifters in the waveguide.

Figure 6:
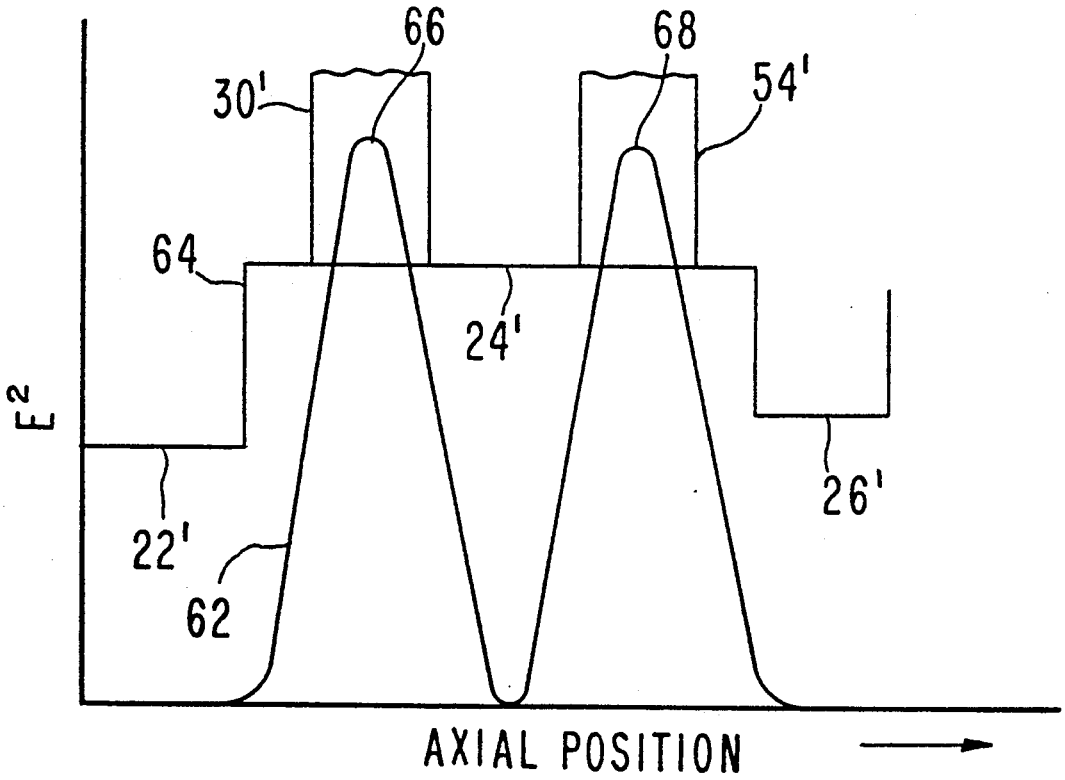
FIG. 6 is a graph of field intensity in a $TE_{nm2}$ mode.

It may become physically impractical to place so many waveguides around the resonator at the same axial position. In that case, the set of mode suppression load ports 54, 56, 58 and 60 is displaced from the set of power-output ports 30, 32, 50, 52. The oscillating mode is then preferably a $TE_{mn2}$. FIG. 6 is a graph of the axial variation of electric field strength (squared) 62 inside the cavity 24'. For simplicity, only one load port 30' and one mode-suppression port 54' are indicated. In this 2-dimensional graph, they are shown in the same axial plane. In 3 dimensions, the two are displaced by 45 degrees as in FIG. 5. Each set of ports 30' et al and 54' et al is placed at an axial maximum of electric field and hence of wall current. The two maxima 66, 68 may be somewhat different in amplitude due to axial growth of the wave, but as long as each set has the required azimuthally symmetry the operation is not impaired. In fact, as described above, it is preferable to have the mode-suppression loading at ports 54, 56, 58 and 60 heavier than the useful output loading at ports 30, 32, 50 and 52, so the mode-suppression ports 54, 56, 58 and 60 are downstream from the load ports. The fact that the fields are out-of-phase at the mode-suppression ports is immaterial because in proper operation there is no excitation of the unwanted degenerate mode.

The above description is of some preferred embodiments. Other embodiments will appear to those skilled in the art. The invention is to be limited by the following claims and their legal equivalents.

We claim:

1. A gyrotron comprising an interaction cavity for supporting a transverse electric field wave in a higher-order mode in a cavity resonator in energy-exchanging relation with an electron beam, means for extracting electromagnetic energy from said cavity into the fundamental modes of a plurality of waveguides, said means comprising at least a pair of coupling apertures in the cavity wall located at positions where the wall currents of said higher-order mode are equal in amplitude and phase, and the wall currents of an unwanted lower-order mode are equal in amplitude and phase, but reversed in direction between said apertures with respect to said wall currents of said higher-order mode.

2. The gyrotron of claim 1 wherein said resonator is an axial cylinder and said pair of coupling apertures are at the same axial position and differ in azimuth by 180 degrees.

3. The gyrotron of claim 2 wherein said high-order mode is a $TE_{nm}$ mode, and comprising a first set of n pairs of apertures at the same axial position and equally spaced azimuthally where n is the azimuthal mode number of the desired mode.

4. The gyrotron of claim 2 wherein said higher-order mode is a $TE_{on}$ mode and said lower-order mode is a $TE_{nm}$ mode and comprising n pairs of apertures at the same axial position and equally spaced azimuthally.

5. The gyrotron of claim 3 further comprising a second set of n pairs of apertures at the same axial position and azimuthally spaced equally from said apertures of said first set.

6. The gyrotron of claim 3 further comprising a second set of n pairs of apertures equally spaced azimuthally and at an axial position removed from said axial position of said first set.

7. The gyrotron of claim 4 further comprising a second set of n pairs of apertures equally spaced azimuthally and at an axial position removed from said first set.

8. The gyrotron of claim 1 wherein said coupling apertures couple wave energy into fundamental-mode waveguides with equal load impedance.

9. The gyrotron of claim 8 further including means for combining the output of at least one pair of said waveguides into one fundamental-mode waveguide.

10. The gyrotron of claim 5 further comprising waveguide means for conducting energy from said second set into waveguides with identical load impedance.

11. The gyrotron of claim 10 wherein said load impedance is such as to provide heavier loading at said second set of apertures than at said first set.

12. The gyrotron of claim 10 wherein said load impedance of said second set is equal to said load impedance of said first set and both sets are connected to useful loads.

13. The gyrotron of claim 12 further including means for combining wave energy from said two sets, said combining means comprising differential phase shifter means for combining said wave energy in phase.

* * * * *